US006276683B1

(12) United States Patent
Such

(10) Patent No.: US 6,276,683 B1
(45) Date of Patent: Aug. 21, 2001

(54) METHOD AND KIT FOR A CONSTANT VALUE JACKPOT GAME OF CHANCE

(75) Inventor: David A. Such, Great Falls, MT (US)

(73) Assignee: D. Allan Such & Associates, Inc., Great Falls, MT (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/697,396

(22) Filed: Oct. 27, 2000

Related U.S. Application Data

(63) Continuation of application No. 09/198,991, filed on Nov. 23, 1998, now Pat. No. 6,145,835

(60) Provisional application No. 60/067,053, filed on Dec. 1, 1997.

(51) Int. Cl.[7] ..... A63B 71/00; A63F 1/18

(52) U.S. Cl. ..... 273/139

(58) Field of Search ..... 273/139

(56) References Cited

U.S. PATENT DOCUMENTS 6,145,835 * 11/2000 Such ..... 273/139

* cited by examiner

*Primary Examiner*—Steven Wong
*Assistant Examiner*—D. Collins
(74) *Attorney, Agent, or Firm*—Webb Ziesenheim Logsdon Orkin & Hanson, P.C.

(57) ABSTRACT

A method of conducting a lottery game by a master game sponsor comprises the steps of producing a plurality of lottery ticket game sets making up one master game, the game sets comprising a plurality of lottery tickets with hidden indicia, the tickets having a tab that can be torn free to reveal the hidden indicia setting forth that some of the tickets entitle the purchaser to instant winnings and/or eligibility for a constant value jackpot associated with the master game, selling game sets from a single master game to vendors who may in turn sell the individual lottery tickets from the game sets, and receiving jackpot tickets and randomly selecting a jackpot winner from those jackpot tickets received and distributing the jackpot prize to the jackpot winner.

2 Claims, 2 Drawing Sheets

METHOD AND KIT FOR A CONSTANT VALUE JACKPOT GAME OF CHANCE

RELATED APPLICATIONS

This application is a continuation of U.S. patent application Ser. No. 09/198,991, filed Nov. 23, 1998 now U.S. Pat. No. 6,145,835. This application claims of the benefit of U.S. Provisional Patent Application No. 60/067,053, filed Dec. 1, 1997.

BACKGROUND OF THE INVENTION

This invention is directed to a game of chance kit and, more particularly, to a game kit for use by charitable organizations, clubs and taverns and the like whereby members or customers can purchase a ticket and instantly win a prize if the ticket is a "winner". These kits are sold through licensed distributors in states where such games are legal. Typically, the kit is purchased by the charitable organization, club or tavern, the tickets are sold and the instant prizes are paid by the kit purchaser. The nwnber of winners is precisely controlled so that the income from ticket sales will exceed the total cost of the instant prizes and so that the ticket purchasers will know in advance the payout if all tickets are purchased.

Game kits have been designed which give the impression of additional levels of play. See, for example, U.S. Pat. No. 5,046,737.

However, the additional levels of play permitting the customer to win a bonus or sweepstakes prize require the bonus or sweepstakes to be funded entirely by the charitable organization, club or tavern selling the sweepstakes winning ticket.

SUMMARY OF THE INVENTION

Briefly, according to this invention, there is provided a lottery game kit comprising a container for a set of game tickets of a preselected number which tickets can be purchased by game players. Each ticket has concealed indicia (symbols or numbers), some of which indicate entitlement to an instant prize and/or eligibility for a constant value jackpot. Each ticket contains indicia of a particular game set and indicia of a master game. A game set comprises all tickets in one container including both winners and losers and possibly one ticket indicating eligibility for the constant value jackpot. A master game comprises all game sets associated with a single constant value jackpot. The lottery game kit further comprises a prize board indicating the correspondence between ticket indicia and instant prizes. The game kit further includes a jackpot poster setting forth the jackpot and instructions for transmitting jackpot tickets to the jackpot sponsor. Each jackpot poster will include the final date for receipt of the name and address of a jackpot ticket purchaser and the winning ticket to the jackpot sponsor. The jackpot sponsor may, for example, be the manufacturer of the game sets. Thus, the jackpot sponsor provides the jackpot prize as an inducement to clubs or taverns to purchase game sets from the sponsor.

BRIEF DESCRIPTION OF THE DRAWINGS

Further features and other objects and advantages of this invention will be made clear from the following detailed description made with reference to the drawings in which.

DESCRIPTION OF THE PREFERRED EMBODIMENTS

Figure 1:
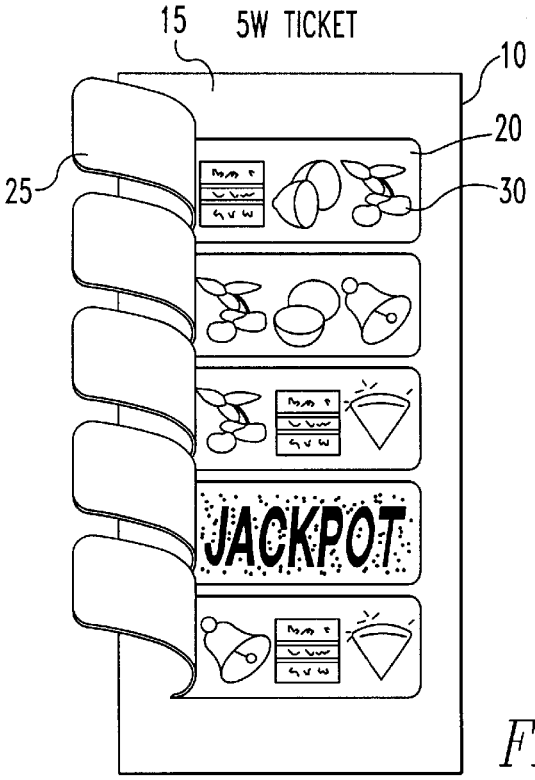
FIG. 1 is a five window ticket.
Figure 2:
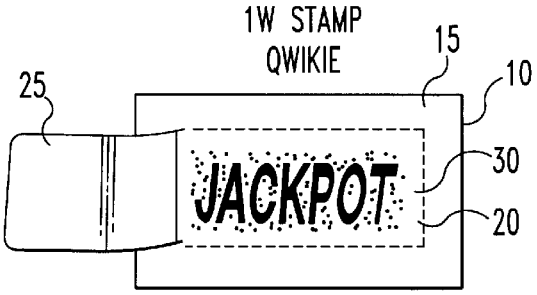
FIG. 2 is a one window ticket.
Figure 3:
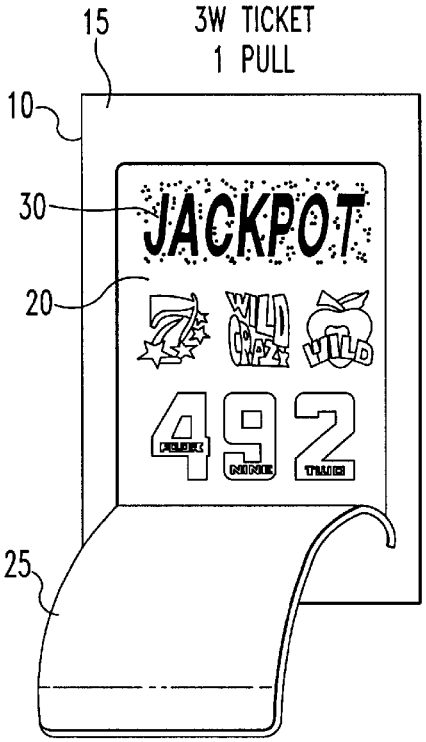
FIG. 3 is a three row pull ticket.
Figure 4:
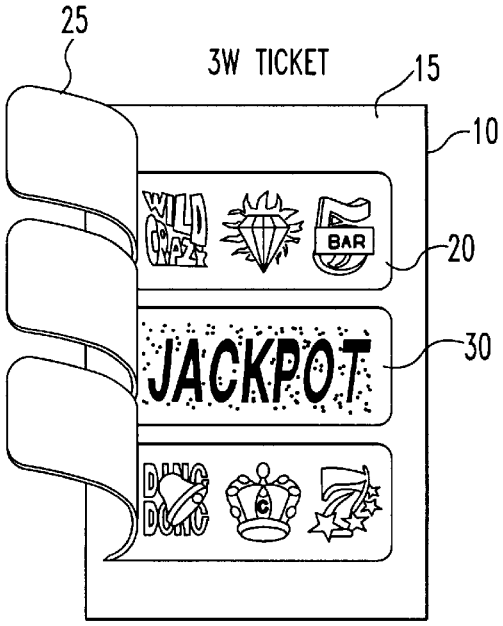
FIG. 4 is a three window ticket.
Figure 7:
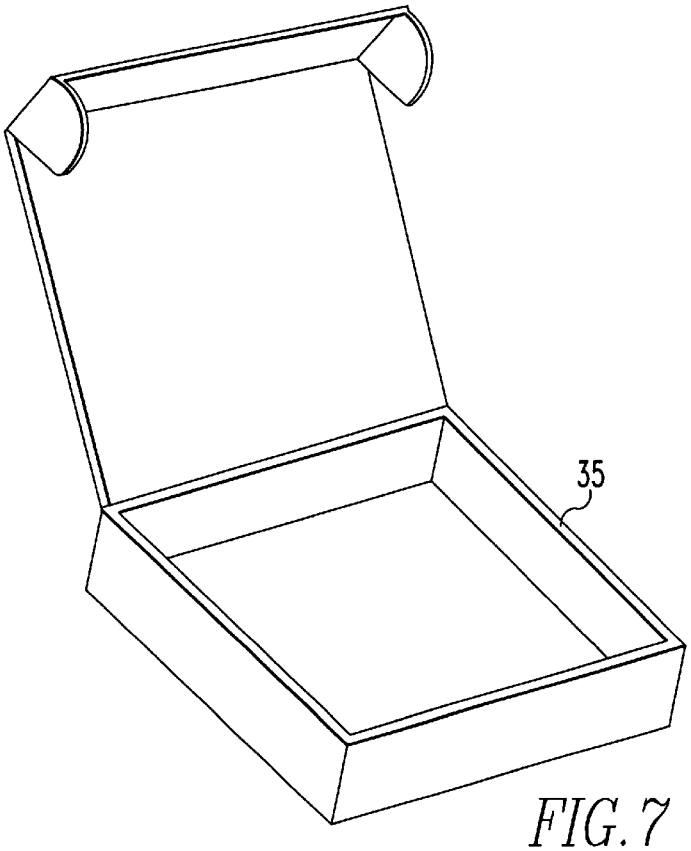
FIG. 7 is a representative container for a plurality of lottery tickets.
Figure 5:
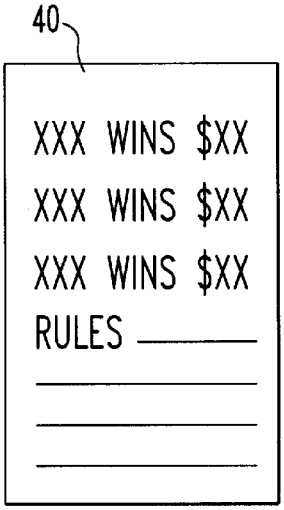
FIG. 5 is a prize board.
Figure 6:
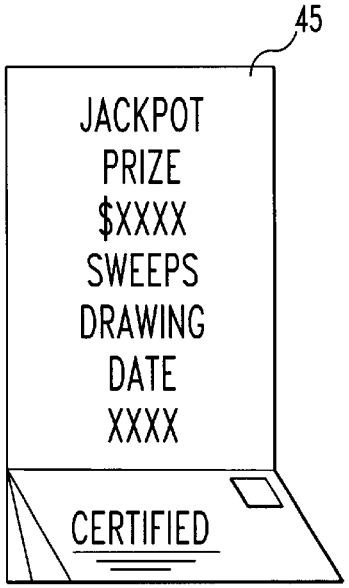
FIG. 6 is a jackpot poster.

Referring now to FIGS. 1 to 4, there are shown tickets which include a laminated upper layer 15 and lower layer 20 of material such that until torn apart by removing a tab 25, the indicia 30 (symbols or numbers) hidden therein are not visible. Alternately, the ticket 10 may be folded and sealed such the until the seal is unbroken and the ticket 10 unfolded, the hidden indicia 30 are not visible. The particular tickets illustrated in FIGS. 1 to 4 are referred to in the industry as pull-tabs. Other types of tickets are suitable for use in game kits according to this invention.

A plurality of lottery tickets may be packaged in a container 35 and a master game is comprised of lottery tickets from a plurality of containers.

The indicia 30 of the game set and master game of each sweepstakes eligible ticket enables an audit of the drawing to reduce the opportunity for fraudulent entries.

A prize board 40 sets forth the rules and the value of instant winning tickets. The prize board 40 displays a number of winners and the number of total tickets in each game set and any other information required by state laws.

A jackpot poster announces and advertises the jackpot prize, the sweepstakes drawing date and may, for example, include instructions for transmitting jackpot tickets to the drawing location.

It should be understood that the jackpot is a ticket that could appear at any time and in any game. There could be one game or many different games being played at any one time. The size of the various games (ticket count) does not matter nor does the name of the game matter. A winning player could receive the jackpot prize either as an instant winner or be required to send the game piece back to the game sponsor for redemption depending on the size of the jackpot being offered. The jackpot could be cash or merchandise. Referring to FIGS. 1 to 4, the game pieces illustrated therein indicate the player is a jackpot winner. The jackpot has no bearing on how many tickets are sold nor does it increase in value as tickets are sold.

In an alternate embodiment, the same symbols, numbers or letters are covered by latex (scratch off) coatings to increase the excitement of playing the game.

Having thus described my invention with the detail and particularity required by the Patent Laws, what is desired protected by Letters Patent is set forth in the following claims.

What is claimed is:

1. A lottery game kit comprising:

a plurality of containers;

a plurality of lottery tickets supplied within each container, said tickets when opened revealing hidden indicia, some of which entitle the lottery ticket purchaser to instant winnings and some of which will entitle the purchaser to eligibility for a constant value jackpot; and a prize board for displaying the constant value jackpot prize, wherein the lottery tickets in all of the containers are part of a master game for eligibility for the constant value jackpot and the lottery tickets in any one container are additionally part of an instant winning game.

2. The lottery game kit according to claim 1, wherein each ticket bears indicia of a particular game set and a master game.

* * * * *